US008221090B2

(12) United States Patent
Kim et al.

(10) Patent No.: US 8,221,090 B2
(45) Date of Patent: Jul. 17, 2012

(54) RECIPROCATING COMPRESSOR STROKE CONTROL BY COMPENSATING MOTOR INDUCTANCE INFLUENCES

(75) Inventors: Hyeung-Ju Kim, Seoul (KR); Ji-Won Sung, Seoul (KR); Chang-Oh Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 1030 days.

(21) Appl. No.: 12/091,162

(22) PCT Filed: Oct. 18, 2006

(86) PCT No.: PCT/KR2006/004222

§ 371 (c)(1),
(2), (4) Date: Apr. 22, 2008

(87) PCT Pub. No.: WO2007/049875

PCT Pub. Date: May 3, 2007

(65) Prior Publication Data

US 2008/0226465 A1 Sep. 18, 2008

(30) Foreign Application Priority Data

Oct. 24, 2005 (KR) ..... 10-2005-0100463

(51) Int. Cl.
*F04B 49/06* (2006.01)

(52) U.S. Cl. ..... 417/44.11; 417/53

(58) Field of Classification Search ..... 417/44.11, 417/44.1, 53, 212, 45, 417; 318/632
See application file for complete search history.

(56) References Cited

U.S. PATENT DOCUMENTS

| | | | | |
|---|---|---|---|---|
| 6,815,922 | B2 * | 11/2004 | Yoo et al. | 318/632 |
| 6,925,823 | B2 * | 8/2005 | Lifson et al. | 62/196.3 |
| 7,025,571 | B2 * | 4/2006 | Jeun | 318/400.08 |
| 7,408,310 | B2 * | 8/2008 | Hong et al. | 318/119 |
| 2002/0158178 | A1 | 10/2002 | Garelick et al. | |
| 2003/0026702 | A1 * | 2/2003 | Yoo et al. | 417/44.11 |
| 2003/0143080 | A1 * | 7/2003 | Yoo et al. | 417/44.1 |
| 2003/0164691 | A1 | 9/2003 | Ueda et al. | |

FOREIGN PATENT DOCUMENTS

| | | | |
|---|---|---|---|
| KR | 10-2004-0101767 | A | 12/2004 |
| KR | 10-0533041 | B1 | 12/2005 |
| WO | WO-02-095923 | A1 | 11/2002 |

* cited by examiner

*Primary Examiner* — Charles Freay
*Assistant Examiner* — Nathan Zollinger
(74) *Attorney, Agent, or Firm* — Birch, Stewart, Kolasch & Birch, LLP

(57) ABSTRACT

An operation controlling apparatus for a reciprocating compressor, and a method thereof, which are capable of accurately controlling the reciprocating compressor by sensing a size of a load applied to the reciprocating compressor and a stroke estimation value of the reciprocating compressor and then compensating a parameter of a motor in the reciprocating compressor based upon the sensing, the operation controlling apparatus comprising a controlling unit a controlling unit for comparing a phase difference between a detected current and a stroke with a reference phase difference to determine a size of a load, and outputting, according to the determined size of the load, a compensation control signal to compensate a parameter of a motor and a stroke control signal to control the stroke.

15 Claims, 5 Drawing Sheets

PRIOR ART
[Fig. 1]
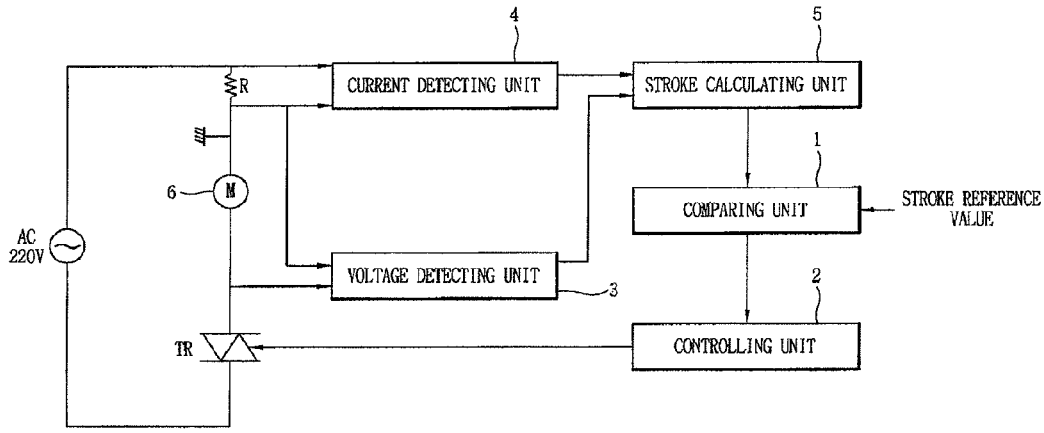
[Fig. 2]
PRIOR ART
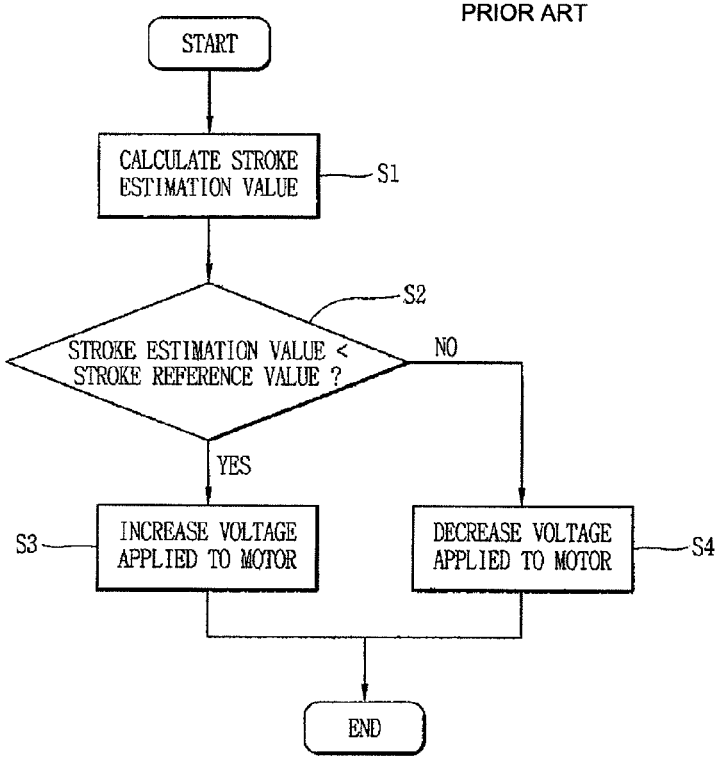

[Fig. 3]
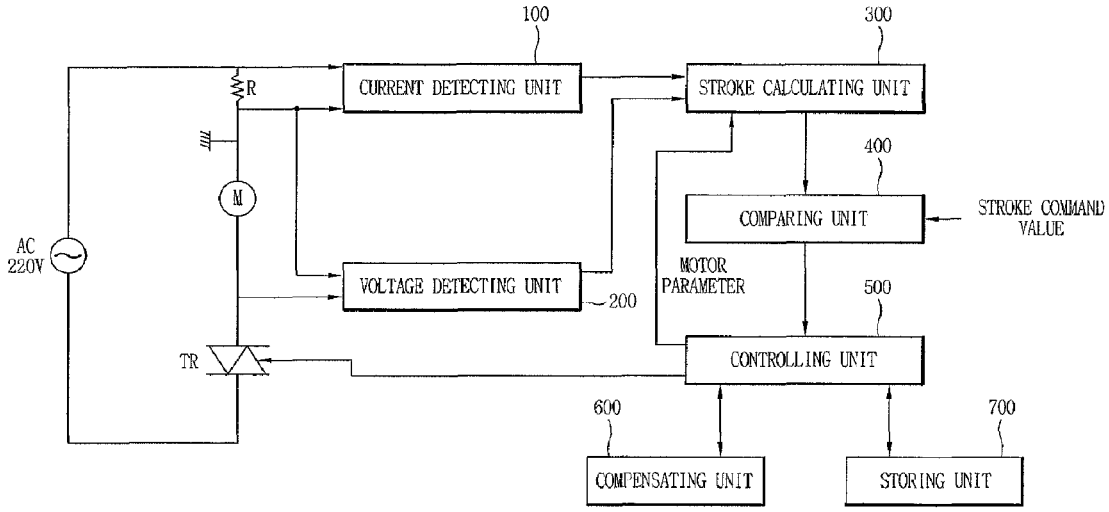

[Fig. 4]
(a)
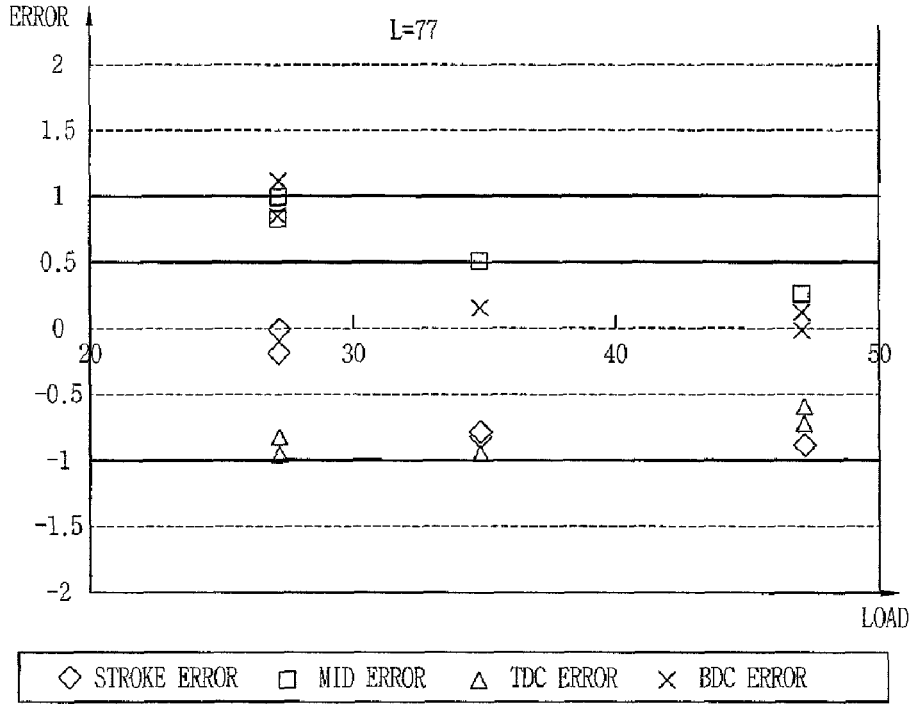
(b)
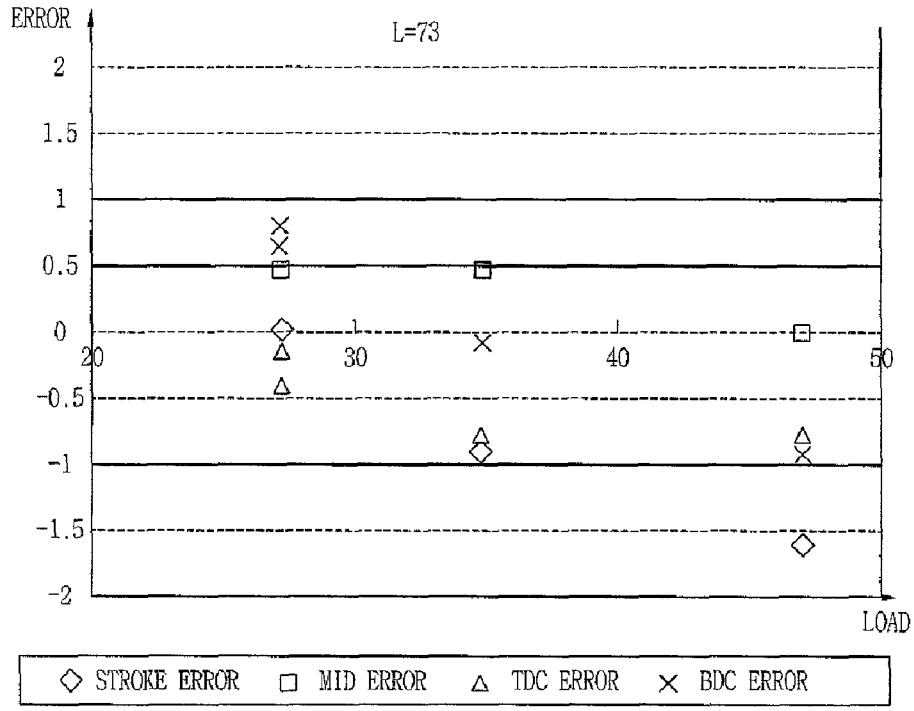

[Fig. 5]
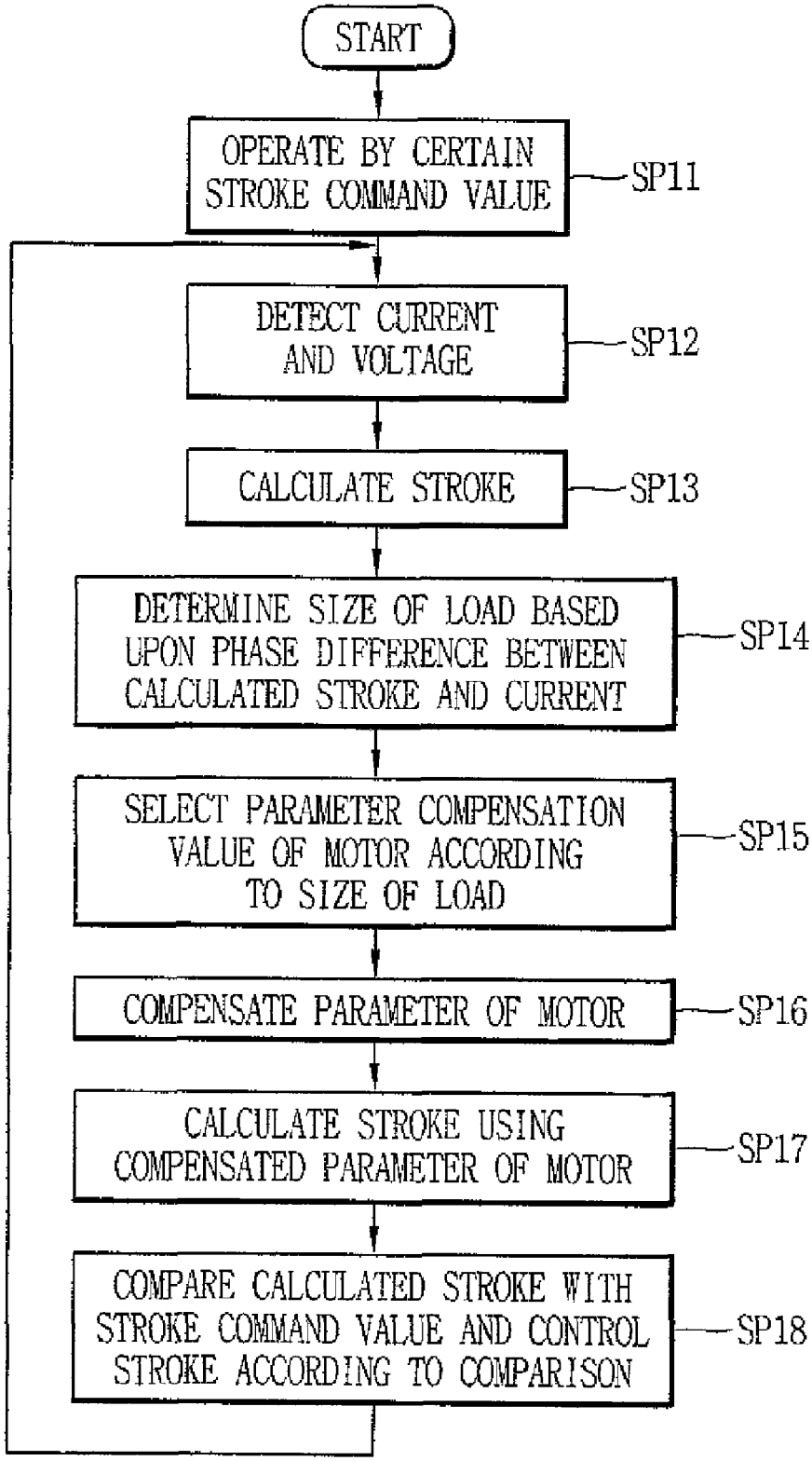

[Fig. 6]
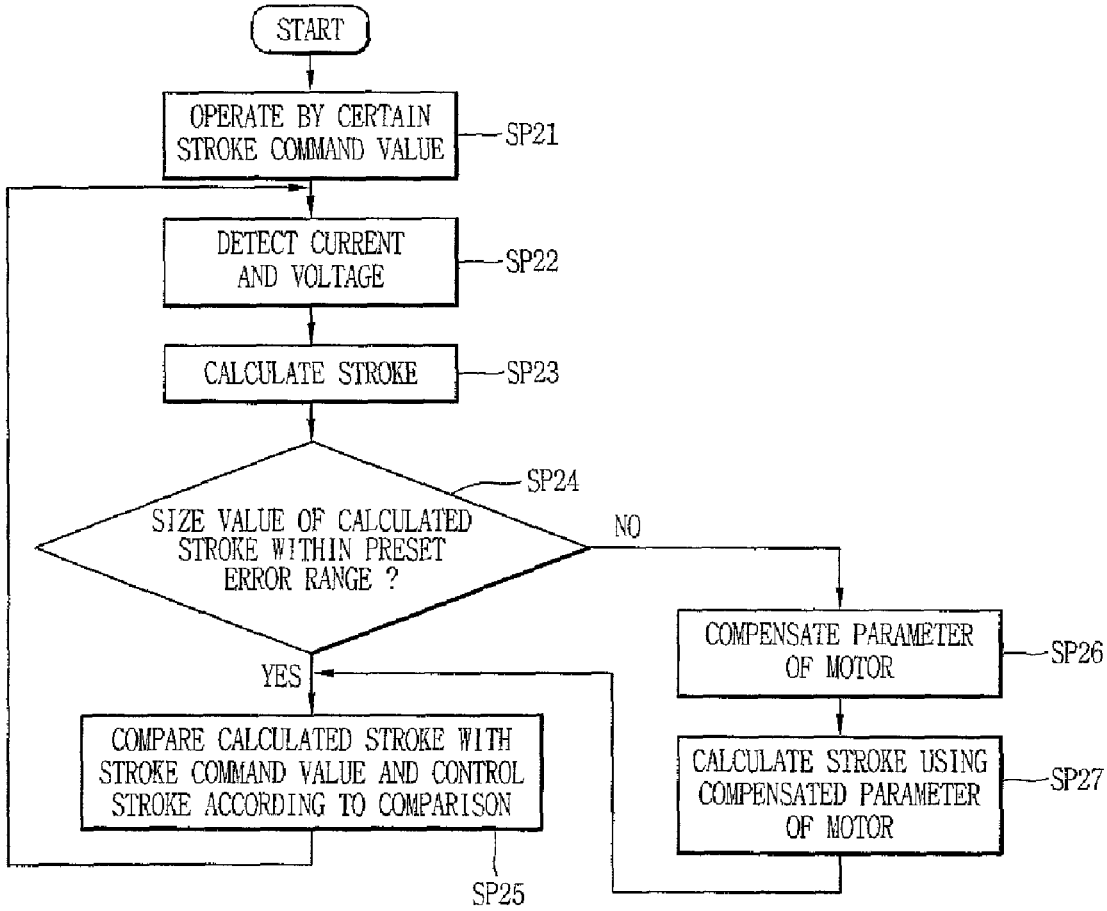

RECIPROCATING COMPRESSOR STROKE CONTROL BY COMPENSATING MOTOR INDUCTANCE INFLUENCES

TECHNICAL FIELD

The present invention relates to a compressor, and particularly, to an operation controlling apparatus for a reciprocating compressor and, a method thereof.

BACKGROUND ART

In general, reciprocating compressors suck and compress a refrigerant gas to thereafter discharge the compressed refrigerant gas while a piston is linearly reciprocated in a cylinder. Also, the reciprocating compressors are classified according to a method for operating the piston into compressors employing a reciprocating method and compressors employing a linear method.

The compressor employing the reciprocating method is implemented such that a crank shaft is coupled to a rotary motor and a piston is coupled to the crank shaft thus to convert a rotation force of the rotary motor into a reciprocation force.

The compressor employing the linear method is implemented by linearly moving a piston connected to a mover of a linear motor.

A reciprocating compressor employing the linear method is not provided with a crank shaft for converting the rotating motion into a linear motion, thus not to have a friction loss due to the crank shaft, which results in a higher compression efficiency as compared to that of typical compressors.

For employing the reciprocating compressor in refrigerators or air conditioners, a voltage is variably applied to a motor in the reciprocating compressor. Accordingly, a compression ratio of the reciprocating compressor can also be varied, thereby enabling a control of cooling capacity of the refrigerators or air conditioners.

When using the reciprocating compressor in the refrigerators or air conditioners, a compression ratio of the linear compressor is varied by varying a stroke voltage applied to the reciprocating compressor. Accordingly, a cooling capacity of the refrigerator or the air conditioner is controlled. Here, the stroke denotes a distance between a top dead center (TDC) of a piston and a bottom dead center (BDC) thereof.

The reciprocating compressor according to the related art will now be explained with reference to FIG. 1.

FIG. 1 is a block diagram showing a construction of an operation controlling apparatus for a related art reciprocating compressor.

As shown in FIG. 1, an operation controlling apparatus of a reciprocating compressor according to the related art may include a current detecting unit 4 for detecting a current applied to a motor of a reciprocating compressor 6, a voltage detecting unit 3 for detecting a voltage applied to the motor, a stroke calculating unit 5 for calculating a stroke estimation value of the compressor based upon the detected current value and a parameter of the motor, a comparing unit 1 for comparing the calculated stroke estimation value with a preset stroke reference value thus to output a difference value therebetween depending on the comparison result, and a stroke controlling unit 2 for controlling an operation (i.e., a stroke) of the compressor by controlling an turn-on period of a triac connected to the motor 6 in series based upon the difference value and then varying the voltage applied to the motor.

Hereinafter, an operation of the operation controlling apparatus for the reciprocating compressor will be explained with reference to FIG. 1.

First, the current detecting unit 4 detects a current applied to the motor of the compressor, and outputs the detected current value to the stroke calculating unit 5.

Here, the voltage detecting unit 3 detects a voltage applied to the motor and outputs the detected voltage value to the stroke calculating unit 5.

The stroke calculating unit 5 calculates a stroke estimation value X of the compressor by substituting the detected current value, the detected voltage value and a parameter of the motor in a following equation 1. The stroke calculating unit 5 then applies the calculated stroke estimation value X to the comparing unit 1.

$$X = \frac{1}{\alpha}\int (V_M - Ri = Li)dt \qquad \text{Formula 1}$$

where the R denotes a motor resistance value, the L denotes a motor inductance value, the $\alpha$ denotes a motor constant, the $V_M$ denotes a voltage value applied to the motor, the $i$ denotes a current value applied to the motor, and the $\dot{i}$ denotes a variation ratio of the current applied to the motor according to time. That is, the $\dot{i}$ denotes a differential value (i.e., di/dt) of the $i$.

Afterwards, the comparing unit 1 compares the stroke estimation value with a stroke reference value, and applies a different value therebetween according to the comparison to the stroke controlling unit 2.

The stroke controlling unit 2 then varies the voltage applied to the compressor 6 based upon the difference value, thereby controlling the stroke of the compressor 6.

Such operation will now be explained with reference to FIG. 2.

FIG. 2 is a flowchart showing an operation controlling method for a related art reciprocating compressor.

First, when the stroke calculating unit 5 applies the stroke estimation value to the comparing unit 1 (S1), the comparing unit 1 compares the stroke estimation value with a preset stroke reference value (S2), and then outputs a difference value according to the comparison to the stroke controlling unit 2.

When the stroke estimation value is smaller than the stroke reference value, the stroke controlling unit 2 increases the voltage amount applied to the motor so as to control the stroke of the compressor (S3), while decreasing the voltage amount applied to the motor when the stroke estimation value is larger than the stroke reference value (S4).

Here, at the time of increasing or decreasing the voltage applied to the motor, a turn-on period of a triac electrically connected to the motor is controlled thus to apply the voltage to the motor.

The stroke reference value can be varied according to a size (small or large) load of the reciprocating compressor. That is, for a great load, the stroke reference value is set to be a great value to prevent decrease in the stroke of the piston, thereby preventing decrease of cooling capacity. For a small load, on the other hand, the stroke reference value is set to be a small value to prevent increase in the stroke of the piston. Accordingly, the cooling capacity is increased and a collision between the piston and a cylinder due to an over stroke can be prevented.

The operation controlling method for the related art reciprocating compressor is implemented such that the voltage and current applied to the motor in the compressor are detected and the stroke estimation value is calculated based upon the detected voltage and current in a sensorless manner so as to control the voltage applied to the motor in the compressor.

DISCLOSURE OF INVENTION

Technical Problem

However, the operation controlling apparatus and method for the reciprocating compressor according to the prior art has a problem that control errors of the reciprocating compressor are generated when the size of the load applied to the reciprocating compressor is varied.

Namely, in the operation controlling apparatus and method for the reciprocating compressor according to the prior art, it is detected that the parameter of the motor, particularly an inductance of the motor, is variable according to peripheral circumstances.

Especially, when the reciprocating compressor is a linear compressor, an inductance value of the motor fluctuates greatly due to the current applied to the motor during operating of the linear compressor and changes of the relative positions of a magnet according to a stroke, and the like.

Therefore, the fluctuation of the inductance of the motor makes it difficult to correctly calculate the stroke estimation value of the linear compressor, which causes an inaccurate control of the linear compressor.

Technical Solution

Therefore, an object of the present invention is to provide an operation controlling apparatus for a reciprocating compressor capable of accurately controlling the reciprocating compressor by detecting a size of a load applied to the reciprocating compressor and then compensating a parameter of a motor in the reciprocating compressor according to the detected size of the load, and a method thereof.

Another object of the present invention is to provide an operation controlling apparatus for a reciprocating compressor capable of accurately controlling the reciprocating compressor by detecting a stroke estimation value of the reciprocating compressor, determining whether the detected stroke estimation value is a value within a preset error range, and then compensating a parameter of a motor in the reciprocating compressor based upon the determination, and a method thereof.

Advantageous Effects

As described above, in the apparatus and method for controlling the operation of the reciprocating compressor, it is effective to allow an accurate control of the reciprocating compressor by detecting the size of the load applied to the reciprocating compressor and compensating the parameter of the motor in the reciprocating compressor according to the detected size of the load.

Also, in the apparatus and method for controlling the operation of the reciprocating compressor, it is effective to allow an accurate control of the reciprocating compressor by sensing the stroke estimation value of the reciprocating compressor, determining whether the sensed stroke estimation value is within a preset error range, and compensating the parameter of the motor in the reciprocating compressor based upon the determination.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a block diagram showing a construction of an operation controlling apparatus for a reciprocating compressor according to the related art;

FIG. 2 is a flowchart showing an operation controlling method for a reciprocating compressor according to the related art;

FIG. 3 is a block diagram showing an operation controlling apparatus for a reciprocating compressor in accordance with the present invention;

FIG. 4 is a graph showing an operation control error of a reciprocating compressor, the error generated when an inductance of a motor is 73 mH and 77 mH;

FIG. 5 is a flow chart showing one embodiment of an operation controlling method for a reciprocating compressor in accordance with the present invention; and FIG. 6 is a flow chart showing another embodiment of an operation controlling method for a reciprocating compressor in accordance with the present invention.

BEST MODE FOR CARRYING OUT THE INVENTION

Description will now be given in detail of the present invention, with reference to the accompanying drawings.

Hereinafter, with reference to FIGS. 3 and 4, explanation will be given of preferred embodiments of an operation controlling apparatus for a reciprocating compressor, and a method thereof, which are capable of accurately controlling a stroke by determining a size of a load according to a phase difference between a current applied to the reciprocating compressor and a stroke and then compensating a parameter of a motor according to the determination.

FIG. 3 is a block diagram showing an operation controlling apparatus for a reciprocating compressor in accordance with the present invention.

As shown in FIG. 3, an operation controlling apparatus for a reciprocating compressor according to the present invention comprises a current detecting unit 100, a voltage detecting unit 200, a stroke calculating unit 300, a comparing unit 400, a controlling unit 500, a compensating unit 600, and a storing unit 700.

The current detecting unit 100 detects a current of a motor in a reciprocating compressor, and the voltage detecting unit 200 detects a voltage of the motor in the reciprocating compressor.

The stroke calculating unit 300 calculates a stroke by using the detected current and the detected voltage.

The comparing unit 400 compares the stroke calculated by the stroke calculating unit 300 with a preset stroke command value to output a difference value therebetween according to the comparison.

The controlling unit 500 outputs a stroke control signal for controlling a stroke of the reciprocating compressor according to the difference value outputted from the comparing unit 400.

Also, the controlling unit 500 detects a phase difference between the current detected from the current detecting unit 100 and the stroke calculated by the stroke calculating unit 300, and compares the detected phase difference with a reference phase difference. The controlling unit 500 accordingly determines a size of a load to output a compensation control signal for compensating a motor parameter based upon the determination.

Here, the controlling unit 500 selects a compensation value based upon the size of the load to compensate a parameter of the motor pre-stored in the storing unit 700. The controlling unit 500 then outputs the selected compensation value as the compensation control signal.

The compensating unit 600 compensates the parameter of the motor in the reciprocating compressor into a new value by referring to the compensation control signal.

Namely, the compensating unit 600 adds and/or subtracts a compensation value for compensating a preset motor parameter by the load to/from the preset motor parameter value of the reciprocating compressor.

The controlling unit 500, in another embodiment, performs its control such that a stroke estimation value of the reciprocating compressor is sensed (detected) to determ ine whether the sensed stroke estimation value is within a preset error range and then a parameter of the motor in the reciprocating compressor is compensated according to the determination.

Here, the parameter of the motor denotes an inductance of the motor.

FIGS. 4(*a*) and 4(*b*) are graphs showing operation control errors of a reciprocating compressor, the errors generated when the inductance of the motor is 73 mH and 77 mH, respectively.

Here, as a stroke error, an error of a motion distance of a piston, a TDC (Top Dead Center) error and a BDC (Bottom Dead Center) error are closer to '0', the linear compressor can be controlled more accurately.

As shown in FIGS. 4(*a*) and 4(*b*), in case the inductance of the motor is 73 mH, the compressor may relatively accurately be controlled when the load is small. Also, in case the inductance of the motor is 77 mH, the compressor can relatively accurately be controlled when the load is large.

Hereinafter, an operation of an operation controlling apparatus for a reciprocating compressor according to the present invention will be explained with reference to FIG. 5.

FIG. 5 is a flow chart showing an operation controlling method for a reciprocating compressor in accordance with an embodiment of the present invention.

First, a motor in a reciprocating compressor operates by a certain stroke command value (SP11).

In this state, the current detecting unit 100 detects a current of the motor in the reciprocating compressor, and the voltage detecting unit 200 detects a voltage of the motor in the reciprocating compressor (SP12).

Afterwards, the stroke calculating unit 300 calculates a stroke using the detected current and the detected voltage (SP13).

The comparing unit 400 compares the stroke command value with the calculated stroke to output a difference value therebetween according to the comparison.

The controlling unit 500 then detects a phase difference between the detected current and the stroke thus to determine a size of a load by comparing the detected phase difference with a reference phase difference (SP14).

Here, the reference phase difference may be set to an optimal value obtained by experiment.

For reference, in the reciprocating compressor, when the load is increased, a gas spring constant becomes greater, which results in a decrease of the phase difference between the current and the stroke.

That is, when the phase difference between the current and the stroke is 90°, a frequency becomes a resonant frequency, and it is determined to be a middle load. Also, when the phase difference between the current and the stroke is about 60°, it is determined to be a high load. These all have been obtained by experiment.

Thus, the reference phase difference may be set to a value greater than 60°.

Here, the reference phase difference may be set at a point lower than a point of TDC=0.

The TDC denotes "Top Dead Center" of a piston in a reciprocating compressor. The TDC denotes a position of the piston upon the completion of a compression process of the piston.

Here, the reciprocating compressor can obtain the most ideal efficiency at the position of TDC=0. Accordingly, when controlling the operation of the reciprocating compressor, the piston is controlled to be at the position of TDC=0.

Afterwards, the controlling unit 500 selects a parameter compensation value of the motor according to the size of the load (SP15). The compensating unit 600 then compensates the parameter of the motor depending on the selected compensation value (SP16).

Here, the compensating unit 600 compensates the preset parameter of the motor, especially, an inductance value of the motor according to the detected size of the load.

Preferably, the compensating unit 600 adds and/or subtracts 2-5% of the preset parameter value of the motor (e.g., a reactance value of the motor) in the reciprocating compressor to/from the preset parameter value of the motor.

The stroke calculating unit 300 calculates a stroke using the compensated parameter of the motor (SP17). The comparing unit 400 compares the calculated stroke with the stroke command value to output a difference value therebetween according to the comparison.

Accordingly, the controlling unit 500 controls a switching of a triac Tr1, based upon the difference value, to change a voltage applied to the reciprocating compressor, thereby controlling the stroke of the reciprocating compressor.

Another embodiment of an operation controlling method for a reciprocating compressor according to the present invention will now be explained with reference to FIG. 6.

Here, the another embodiment of the operation controlling method for a reciprocating compressor according to the present invention may include sensing (detecting) whether the stroke of the reciprocating compressor is within a preset error range.

First, a motor in a reciprocating compressor operates by a certain stroke command value (SP21).

In this state, the current detecting unit 100 detects a current of the motor in the reciprocating compressor, and the voltage detecting unit 200 detects a voltage of the motor in the reciprocating compressor (SP22).

Afterwards, the stroke calculating unit 300 calculates a stroke using the detected current and the detected voltage (SP23).

The comparing unit 400 compares the stroke command value with the calculated stroke to output a difference value therebetween according to the comparison.

Then, the controlling unit 500 determines whether the size of the calculated stroke is within a preset error range (SP24).

The controlling unit 500 then controls the stroke according to the difference value calculated by the comparing unit 400 when it is determined in the step SP24 that the size of the calculated stroke is within the preset error range.

The controlling unit 500 selects a parameter compensation value of the motor from the storing unit 700 when it is determined in the step SP24 that the size of the calculated stroke is not within the preset error range. The compensating unit 600 accordingly compensates the parameter of the motor depending on the selected compensation value (SP26).

Here, the storing unit 700 pre-stores the parameter compensation value of the motor based upon the stroke size error, which has been obtained by experiment.

Here, the compensating unit 600 compensates the preset parameter of the motor, especially, an inductance value of the motor according to the detected size of the load.

Afterwards, the stroke calculating unit 300 calculates a stroke using the compensated parameter of the motor (SP27). The comparing unit 400 compares the calculated stroke with the stroke command value to output a difference value therebetween according to the comparison.

Accordingly, the controlling unit 500 controls a switching of a triac Tr1, based upon the difference value, to change a voltage applied to the reciprocating compressor, thereby controlling the stroke of the reciprocating compressor.

That is, the present invention can be implemented to accurately control the stroke of the reciprocating compressor by comparing the phase difference between the current applied to the reciprocating compressor and the stroke with the reference phase difference to determine the size of the current load and then compensating the parameter of the motor according to the determined size of the load.

Also, the present invention can allow an accurate control of the stroke by calculating the stroke applied to the reciprocating compressor, comparing the calculated stroke with the stroke command value, and then compensating the parameter of the motor when the difference value according to the comparison is not within a preset error range.

The invention claimed is:

1. An operation controlling apparatus for a reciprocating compressor comprising:

a controlling unit for comparing a phase difference between a detected current and a stroke with a reference phase difference to determine a size of a load, selecting an inductance compensation value of a motor according to the determined size of the load, and outputting a compensation control signal according to the selected inductance compensation value to compensate an inductance of a motor and outputting a stroke control signal to control the stroke.

2. The apparatus of claim 1, wherein the controlling unit outputs the compensation control signal by which the selected inductance compensation value is added to or subtracted from an inductance value of the motor in the reciprocating compressor.

3. The apparatus of claim 2, further comprising a storing unit in which the selected inductance compensation value is pre-stored.

4. The apparatus of claim 2, further comprising a compensating unit for adding and/or subtracting, based upon the compensation control signal, the selected inductance compensation value to/from the inductance value of the motor in the reciprocating compressor.

5. The apparatus of claim 1, wherein the controlling unit senses whether the stroke of the reciprocating compressor is controlled within an error range, and compensates the inductance of the motor according to the sensing.

6. An operation controlling apparatus for a reciprocating compressor comprising:

a current detecting unit for detecting a current applied to a motor in a reciprocating compressor;

a voltage detecting unit for detecting a voltage applied to the motor in the reciprocating compressor;

a stroke calculating unit for calculating a stroke estimation value of the reciprocating compressor based upon the detected current value, the detected voltage value and a compensated inductance of the motor;

a comparing unit for comparing the calculated stroke estimation value with a stroke command value to output a difference signal therebetween according to the comparison; and a controlling unit for controlling the stroke of the compressor based upon the outputted difference signal, comparing a phase difference between the detected current and the stroke with a reference phase difference to determine a size of a load, selecting an inductance compensation value of a motor according to the determined size of the load, and outputting a compensation control signal according to the selected inductance compensation value to compensate the inductance of a motor and a stroke control signal to control the stroke.

7. The apparatus of claim 6, wherein the controlling unit outputs the compensation control signal by which the selected inductance compensation value is added to or subtracted from an inductance value of the motor in the reciprocating compressor.

8. The apparatus of claim 7, further comprising a storing unit in which the selected inductance compensation value is pre-stored.

9. The apparatus of claim 7, further comprising a compensating unit for adding and/or subtracting, based upon the compensation control signal, the selected inductance compensation value to/from the inductance value of the motor in the reciprocating compressor.

10. The apparatus of claim 6, wherein the controlling unit senses whether the stroke of the reciprocating compressor is controlled within an error range, and compensates the inductance of the motor according to the sensing.

11. An operation controlling method of a reciprocating compressor comprising:

detecting a size of a load applied to a reciprocating compressor;

selecting an inductance compensation value corresponding to the detected size of the load;

compensating an inductance of the motor by applying the selected inductance compensation value to an inductance value of the motor in the reciprocating compressor based upon the detected size of the load; and controlling a stroke of the reciprocating compressor by employing the compensated inductance of the motor, wherein detecting the size of the load comprises:

detecting voltage and current applied to the reciprocating compressor;

calculating a stroke applied to the reciprocating compressor using the detected current and voltage; and detecting a phase difference between the calculated stroke and the detected current to compare the detected phase difference with a reference phase difference, and then detecting the size of the load based upon the comparison.

12. The method of claim 11, further comprising pre-storing the selected inductance compensation value.

13. The method of claim 11, wherein controlling the stroke comprises:

calculating the stroke of the reciprocating compressor based upon the detected current and voltage and the compensated inductance of the motor; and comparing the calculated stroke with a stroke command value and controlling the stroke applied to the reciprocating compressor based upon a difference signal according to the comparison.

14. The method of claim 11, further comprising sensing whether the stroke of the reciprocating compressor is controlled within an error range, and compensating the inductance of the motor according to the sensing.

15. The method of claim 11, further comprising sensing, based upon an operational frequency for controlling the stroke of the reciprocating compressor, whether the stroke of the reciprocating compressor is controlled within an error range, and compensating the inductance of the motor according to the sensing.

* * * * *